US006588450B2

(12) United States Patent
Ijiri et al.

(10) Patent No.: US 6,588,450 B2
(45) Date of Patent: Jul. 8, 2003

(54) STORAGE TANK FOR VISCOUS OIL CONTAINING EASILY POLYMERIZABLE COMPOUNDS

(75) Inventors: Yuichi Ijiri, Himeji (JP); Yukihiro Matsumoto, Kobe (JP); Sei Nakahara, Himeji (JP); Fumio Munechika, Himeji (JP)

(73) Assignee: Nippon Shokubai Co., Ltd., Osaka-fu (JP)

( * ) Notice: Subject to any disclaimer, the term of this patent is extended or adjusted under 35 U.S.C. 154(b) by 109 days.

(21) Appl. No.: 09/788,598

(22) Filed: Feb. 21, 2001

(65) Prior Publication Data

US 2001/0018931 A1 Sep. 6, 2001

(30) Foreign Application Priority Data

Feb. 21, 2000 (JP) ..... 2000-043411

(51) Int. Cl.[7] ..... F17D 1/14
(52) U.S. Cl. ..... 137/563
(58) Field of Search ..... 137/563, 590, 137/592; 366/159.1

(56) References Cited

U.S. PATENT DOCUMENTS 3,754,734 A * 8/1973 Hoyle et al. ..... 366/159.1
3,874,399 A * 4/1975 Ishihara ..... 137/563
6,214,619 B1 * 4/2001 Sato et al. ..... 435/397
6,414,183 B1 * 7/2002 Sakamoto et al. ..... 560/218

* cited by examiner

*Primary Examiner*—Gerald A. Michalsky
(74) *Attorney, Agent, or Firm*—Wenderoth, Lind & Ponack, L.L.P.

(57) ABSTRACT

This invention relates to a storage tank for a viscous oil containing easily polymerizable compounds. The storage tank of the present invention for storing viscous oil containing easily polymerizable compounds comprises a bottom plate, a side wall, a draw-off pipe and an inlet pipe. The bottom plate slopes downwardly toward the draw-off pipe, and an angle of downward inclination of the bottom plate is a gradient of at least 1/200. It becomes possible because of the storage tank to effectively prevent polymerization of easily polymerizable compounds contained in waste oil within the storage tank, and clogging of a pipe is suppressed considerably.

21 Claims, 2 Drawing Sheets

STORAGE TANK FOR VISCOUS OIL CONTAINING EASILY POLYMERIZABLE COMPOUNDS

BACKGROUND OF THE INVENTION

1. Field of the Invention

This invention relates to a tank for storing a viscous oil containing easily polymerizable compounds. In particular, the invention pertains to a storage tank for bottom liquid which is obtained by distilling a crude liquid to obtain an easily polymerizable compound such as (meth)acrylic acid and/or liquid containing such a compound.

2. Description of the Prior Art

Conventionally, distillation (employing a distillation tower) has been utilized for producing an easily polymerizable compound such as (meth)acrylic acid and/or (meth) acrylic ester from a crude liquid. Distillation is an operation in which a crude liquid composed of two or more liquids in a mixed manner, each having a different boiling point, is heated for vaporization. During distillation, a gas (or vapor) mainly composed of a component having a lower boiling point is condensed and removed from the distillation tower. Also, a liquid mainly composed of a component having a high boiling point is stored at a bottom of the distillation tower. The liquid stored at the bottom may be redistilled for recovering active principles of the liquid and thus condensed liquid, which is also stored at the bottom has high viscosity and is removed continuously or non-continuously form the distillation tower as a waste oil and is fed to a tank for storing thereof. The waste oil stored in the storage tank may be transferred to a waste oil processing unit such as combustion equipment, and the waste oil may be disposed by performing a burning treatment or another treatment.

Since the waste oil has high viscosity, the waste oil in the storage tank is stored at relatively high temperatures to lower its viscosity. Even though storing the waste oil at the high temperatures is effective to lower its viscosity, the high temperatures facilitate polymerization of easily polymerizable compounds contained in the waste oil. In this case, a stabilizer such as a polymerization inhibitor is added to the waste oil to prevent polymerization of the compounds. Even though the stabilizer suppresses polymerization of easily polymerizable compounds, the stabilizer tends to be precipitated easily at high temperatures. Because of these properties of the waste oil, polymerization inevitably would occur in the storage tank. Polymerization products cause problems of clogging a pipe which connects the storage tank and a waste oil processing unit. Also, polymerization products cause clogging of a pipe of an attached unit.

A polymerization product which is adhered to an inside wall of the pipes hampers the ability of transferring the waste oil to the waste oil processing unit, and needs to be removed manually or chemically at regular intervals. These removing operations lower waste oil treatment efficiency and even lower distillation efficiency.

SUMMARY OF THE INVENTION

A storage tank for storing viscous oil containing easily polymerizable compounds, comprises a bottom plate 12, a side wall 13, a draw-off pipe 3 and an inlet pipe 2. The bottom plate 12 slopes downwardly toward the draw-off pipe 3, and an angle of downward inclination of the bottom plate 12 is a gradient of at least 1/200.

DETAILED DESCRIPTION OF THE PREFERRED EMBODIMENTS OF THE INVENTION

Figure 1:
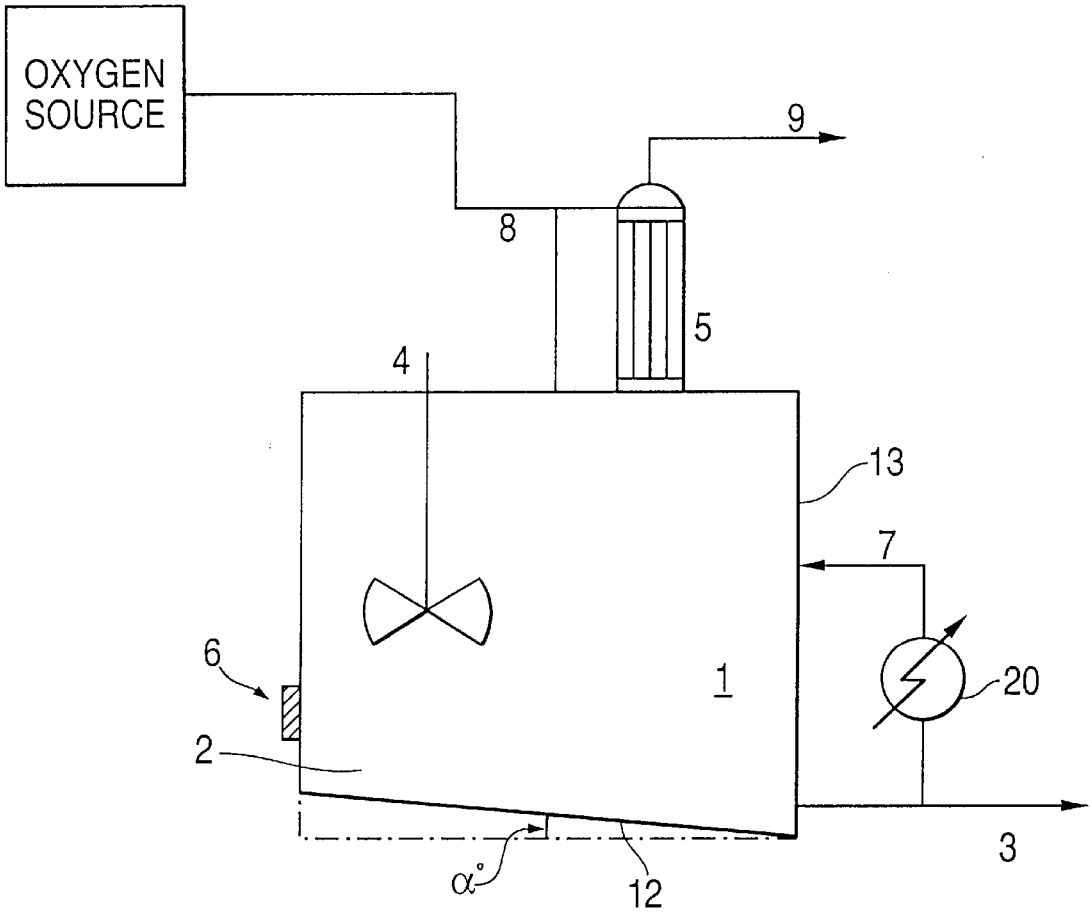
FIG. 1 is a schematic diagram of a storage tank in accordance with one embodiment of the invention.

As a result of thorough investigation, the inventors of this invention found out that providing a storage tank with a bottom plate having downward slope toward a waste oil draw-off pipe which is connected to a side wall of the storage tank and/or installing the waste oil draw-off pipe at a lowermost part of the bottom plate can remarkably prevent waste oil sequestration in the storage tank. Accordingly, the present invention can reduce an amount of waste oil that remains without flowing in the tank, and effectively draw off the waste oil thorough the draw-off pipe. With prompt draw off of the waste oil from the storage tank, it becomes possible to effectively prevent polymerization of easily polymerizable compounds contained in the waste oil within the tank, and clogging of a pipe is suppressed considerably.

According to the present invention, "waste oil" herein means an oil containing easily polymerized compounds, and also an oil having high viscosity. "High viscosity" and "strong viscosity" mean a viscosity having 0.001 to 1 Pa·s (also 1 to 1000 cp) at a treated temperature (normally, the temperature is in the range of 20 to 200° C.). "Easily polymerizable compounds" herein means a compound which is liable to be polymerized during its treatment at its treatment temperature. To be more specific, (meth)acrylic acid and its ester such as methyl ester, ethyl ester, n-propyl ester, isopropyl ester, n-butyl ester, isobutyl ester, 2-hydroxy ethyl ester and N,N-dimethyi amino ethyl ester can be exemplified as easily polymerizable compounds.

Accordingly, the waste oil to be treated in the present invention may be a liquid consisting of at least one selected from easily polymerizable compounds or may be a liquid containing at least one selected from the easily polymerizable compounds mentioned above. Also, the waste oil may be a bottom liquid (also referred to as "bottoms") which is obtained by distilling a liquid containing easily polymerizable compounds for refining or condensing the easily polymerizable compounds.

The waste oil used in the present invention may be bottoms obtained form the following acrylic acid production process. Acrylic acid is recovered by contacting an acrylic acid, containing gas obtained through gas-phase catalytic oxidation of propylene and/or acrolein, with water to trap the acrylic acid in the form of an aqueous solution, distilling the aqueous acrylic acid solution in an azeotropic separation column in the presence of an azeotropic solvent, and purifying crude acrylic acid obtained from a bottom part of the azeotropic separation column in a high boiling impurities separation column. Acrylic acid is recovered from a bottom liquid of the high boiling impurities separation column (.i.e. the high boiling impurities containing acrylic acid dimer, acrylic acid and maleic acid).

Even more specifically, in the above acrylic acid production process, the high boiling impurities containing acrylic acid dimer, acrylic acid and malefic acid into an acrylic acid are introduced into a recovery column composed of a distillation column equipped with a thin film vaporizer, distillation is conducted under conditions of 10 to 100 mmHg with a bottom temperature of the column being of 60 to 120° C., and acrylic acid is distilled off from a column top and then recovered. Bottoms are introduced from the thin film vaporizer into a pyrolyzing tank, whereat acrylic acid dimer in the bottoms are decomposed at temperatures of 120 to 220° C., and thereafter, at least a part of bottoms of the pyrolyzing tank is recirculated into the thin film vaporizer and/or the distillation column, at a ratio of 1 to 20 times in volume with respect to the high boiling impurities containing acrylic acid dimer, acrylic acid and malefic acid. The present invention is preferably applicable to the condensed bottoms obtained from the above process. Details of the method for recovering acrylic acid described in EP0887334A1 are incorporated by reference.

The present invention will be further illustrated with reference to FIG. 1, which is a schematic diagram of one embodiment of a storage tank for use in the invention. It should be noted that the embodiment of FIGS. 1 to 4 is just an example of an apparatus usable in the method of the present invention, and the present invention does not necessarily use this apparatus.

A feature of the present invention resides in employing a bottom plate 12 of a storage tank 1, which bottom plate 12 slopes downwardly toward a waste oil draw-off pipe 3 as depicted in FIG. 1. An angle $\alpha$ of downward inclination of the bottom plate 12 is a gradient of at least 1/200, more preferably at least 1/100, and even more preferably at least 1/50. It is highly possible to accumulate polymerized products at a bottom of the storage tank 1, which would result in clogging the draw-off pipe 3 if the angle $\alpha$ is smaller than 1/200.

An upper limit of the angle $\alpha$ is not specifically limited but preferably is 1/1, and most preferably 1/1.5, for lowering tank manufacturing costs.

A method of forming such a gradient a of the bottom plate 12 is not specifically limited. As an example, a concrete foundation may be prepared to have a desired gradient $\alpha$ prior to installing a storage tank 1. The gradient $\alpha$ can be formed by installing a bottom plate 12 to have such a predetermined gradient $\alpha$.

If the bottom plates 12 slopes in this way, it becomes possible to effectively draw off stored waste oil and reduce an amount of waste oil that remains without flowing in the storage tank 1.

The waste oil draw-off pipe 3 is preferably equipped at a lower most part of a side wall 13. The lower the draw-off pipe 3 is installed, the more the waste oil can be drawn off from the storage tank.

According to the present invention, an agitator 4 is preferably installed in the storage tank 1 for stirring waste oil In the storage tank 1. Any type of agitator which can stir waste oil In the storage tank 1 can be employed as the agitator 4. The agitator 4 may be an agitator having a paddle wheel, a propeller or turbine blades. The number of agitators installed in the storage tank 1 is not specifically limited. The agitator 4 may be used alone or in combination with other types of agitators. A plurality of agitators may be installed so as to form a multi-stage type (e.g. the agitators may be installed so as not to exist at the same horizontal level with respect to each other).

The agitator 4 improves homogenization of composition of the waste oil in the storage tank 1, which results in effectively suppressing polymerization of easily polymerizable compounds, and also suppressing precipitation of a stabilizer. The agitator 4 is effective to reduce the amount of waste oil that remains without flowing in the tank.

A condenser 5 for condensing liquid from vapor is preferably attached to the storage tank 1. Waste oil at a high temperature which is fed to the storage tank is liable to be vaporized. From an environmental viewpoint, it is unfavorable to discharge vapor from the storage tank to the atmosphere without treating the vapor.

Vapor introduced into the condenser 5 is condensed into liquid and residual gas may be processed by a known conventional treatment before discharging the residual gas to the atmosphere. Condensed liquid may be fed back to the storage tank 1 or may be fed to another treatment process unit. Any type of condenser can be used, and a position at which the condenser 5 is equipped to the storage tank 1 is not specifically limited. The condenser 5 is preferably mounted on the storage tank 1 as shown in FIG. 1, and a shell tube type heat exchanger or an in line vapor-liquid condenser, is preferably employed as the condenser. When a vent line of the condenser is large or an amount of vapor is small, a double pipe condenser is preferably employed by lengthening the vent line and attaching a jacket to cover the vent line.

A liquid-level meter for measuring a waste oil level in the storage tank 1 is preferably attached to the storage tank 1. A diaphragm type liquid level meter is preferably employed for detecting the waste oil level. The diaphragm type liquid level meter has advantages in that the diaphragm type liquid level meter has a simple structure and it also has a smaller area that contacts with the waste oil, as compared with other known liquid-level meters. The smaller contact area enables to be reduced an amount of a waste oil hold-up part in the tank, which results in effectively suppressing polymerization in the tank.

Figure 2:
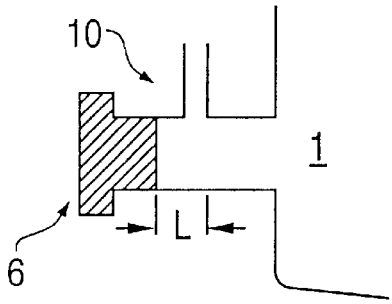
FIG. 2 is a schematic diagram of installation of a diaphragm liquid level meter in accordance with one embodiment of the invention.

A diaphragm type liquid level meter 6 is preferably attached to a side wall of the storage tank 1 such that a surface of the diaphragm type liquid level meter is preferably flushly mounted with an inner surface of this side wall as shown in FIG. 1. Also as shown in FIG. 2, the diaphragm type liquid level meter 6 can be attached to the storage tank 1 by connecting one end of T-shaped connector 10 to the tank. One end of the connector 10 is attached to the diaphragm type liquid level meter 6, another end, which is co-linear with respect to the diaphragm type liquid level meter 6, is connected to the storage tank 1, and a final end, which laterally extends from a co-linear pipe extending between the meter 6 and tank 1, is connected with a waste oil inlet pipe 2. The shorter the length L (i.e. a length between the liquid level meter 6 and a waste oil inlet pipe 2 connect point), the more the polymerization of easily polymerizable compounds in the waste oil existing in this part L can be suppressed.

A waste oil return pipe 7 for returning part of waste oil removed from the waste oil draw-off pipe 3 to the storage tank 1 is preferably installed according to the present invention.

A part of the waste oil which is withdrawn from the storage tank 1 through the draw-off pipe 3 is preferably returned to the storage tank 1 through the waste oil return pipe 7 by a circulating pump (not shown). It becomes possible to make composition of the waste oil in the storage tank homogenous and to prevent polymerization of the waste oil.

Polymerization of easily polymerizable compounds in the waste oil is effectively suppressed when the waste oil maintains a uniform composition in the storage tank 1. It should be noted that the waste oil return pipe 7 is preferably equipped with heat insulating material, such as insulation jacket, for preventing heat loss and for suppressing generation of precipitates in the waste oil return pipe 7. A heat exchanger 20 can be installed at any position of the waste oil return pipe 7 for regulating temperature of the waste oil.

An oxygen-containing gas supply device for supplying oxygen containing gas to the storage tank 1 and/or to the condenser 5 is preferably employed according to the present invention. The oxygen-containing gas can be supplied to the storage tank 1 and/or to the condenser 5 through an oxygen-containing gas supply pipe 8 (another end of the pipe 8 is connected to an oxygen-containing gas supply source. The oxygen-containing gas can also be supplied to the storage tank 1 by admixing with the waste oil to be supplied to the storage tank. The oxygen-containing gas can effectively suppress polymerization of easily polymerlzable compounds. An amount of the oxygen-containing gas supplied is not specifically limited as long as the supplied amount is sufficient for suppressing polymerization. More specifically, it is recommended to add the oxygen-containing gas at a rate of 0.1% (oxygen concentration is preferably 10% or less) by tank volume per hour with respect to total tank volume.

A temperature controlling device for maintaining the waste oil temperature in the storage tank 1 at a desired temperature is preferably employed according to the present invention. Polymerization of easily polymerizable compounds and precipitation of a stabilizer in the storage tank is effectively suppressed by regulating a temperature of liquid stored in the storage tank 1. Any type of temperature controlling devices can be employed according to the present invention. As the temperature controlling device, a heating jacket or coil can be installed around an outside wall of the storage tank 1, or a heat exchanger can be installed at any position of the waste oil return pipe 7 which can heat or cool the waste oil traveling therethrough.

Figure 3:
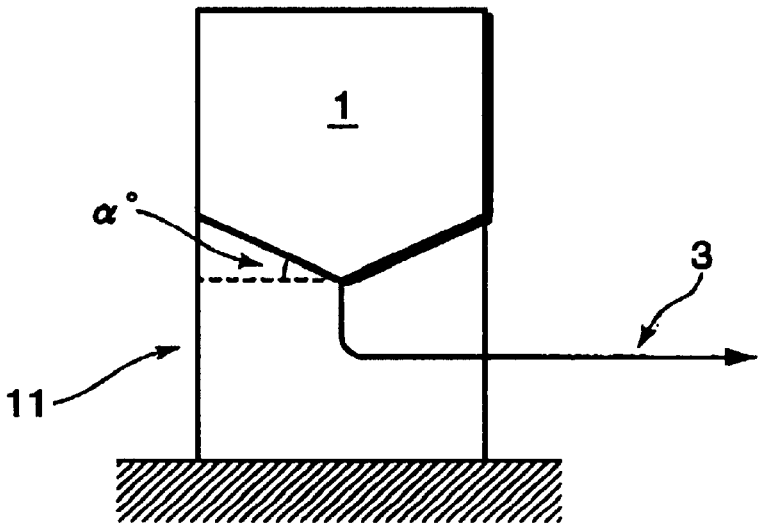
FIG. 3 is a schematic diagram of a storage tank in accordance.with one embodiment of the invention.
Figure 4:
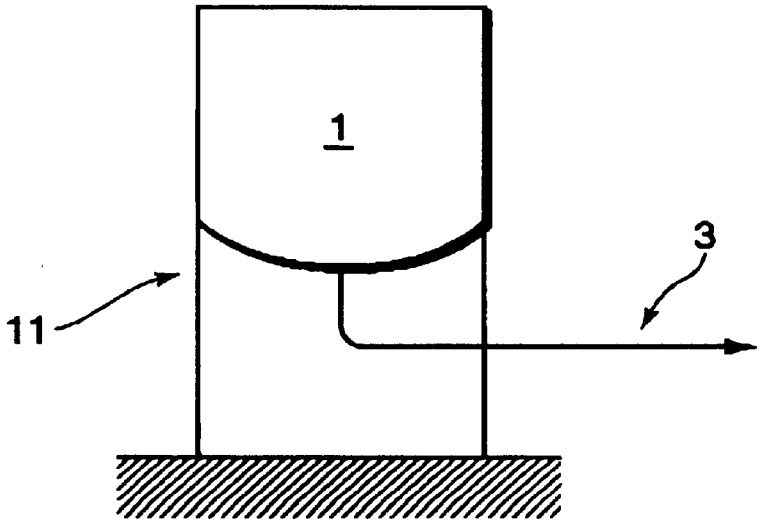
FIG. 4 is a schematic diagram of a storage tank in accordance with one embodiment of the invention.

FIG. 3 and FIG. 4 are schematic side views of a storage tank in accordance with other embodiments of the invention. In FIG. 3, a storage tank 1 has a circular cone type bottom plate, and in FIG. 4, a storage tank 1 has a curved type bottom plate. In both cases, the storage tank 1 may be supported by struts 11. Waste oil supply pipe 2 (not shown in FIG. 3 and in FIG. 4) can be connected the storage tank 1 at any desired position of the tank, and also the waste oil return pipe 7, and other devices such as condenser 5 liquid level meter 6, and agitator 4 (as disclosed with regard to FIG. 1 but also not shown in FIG. 3 and FIG. 4) can be equipped at any desired position of the storage tank 1 if necessary. The waste oil draw-off pipe 3 is preferably equipped at a lowermost part of the bottom plate as shown in FIG. 3 and in FIG. 4. It becomes possible to draw off the stored waste oil and reduce an amount of waste oil that remains without flowing in the tank 1, which effectively prevents polymerization. When utilizing the storage tank 1 such as shown in FIG. 3, the bottom plate is preferably sloped at the angle $\alpha$ as mentioned above to obtain effective draw off of the stored waste oil and reduce the amount of the waste oil that remains without flowing in the storage tank 1.

As long as the waste oil draw-off pipe 3 is connected to the lowermost part of the bottom plate, a position of the lowermost part of the bottom plate is not specifically limited as shown in FIG. 3 and in FIG. 4. The lowermost part may be positioned at a center of the bottom plate or may be positioned at any other location of the bottom plate.

The storage tank 1 of the present invention may be of any convenient shape which is commonly used for bottoms. Generally, tanks having a circular or square shape in horizontal cross section are used. Shape of a roof at a top of the storage tank 1 is not particularly limited either. For example, the storage tank 1 may be a cone-roof,dome-roof or flat-roof tank.

Shape of the bottom plate 12 is not limited to any specific shape. The bottom plate is preferably a flat plate for easy installation.

Furthermore, ancillary devices preferably used in the invention, such as a heat exchanger (not shown), and circulating pump (not shown), are not limited to specific types or constructions.

Positions where the waste oil supply pipe 2, waste oil draw-off pipe 3 and waste oil return pipe 7 are connected to the storage tank 1 are not particularly limited. For example, the waste oil supply pipe 2 may be connected to a side wall or roof of the storage tank 1. The liquid return pipe 7 may be connected to a side wall or roof of the storage tank 1. Ends of these pipes 2, 3 and 7 may or may not extend into the interior of the storage tank 1. The position of the waste oil supply pipe 2 and waste oil return pipe 7 in relation to the waste oil draw-off pipe 3 is not specifically limited to any specific position. It is preferable to connect the waste oil supply pipe 2 in a manner that can effectively reduce possibility of formation of waste oil hold-up parts in the storage tank. When assuming that the waste oil supply pipe 2 and the waste oil draw-off pipe 3 are located at the same height, a feed opening of the waste oil supply pipe 2 is preferably positioned on an extended line joining an inhalation opening of the waste oil draw-off pipe 3 and a central point of a horizontal cross section of the storage tank 1.

The invention will be further illustrated in detail with reference to several inventive examples and comparative examples below which are not intended to limit the scope of the invention.

EXAMPLE 1

A waste oil was obtained from an acrylic acid production process. High boiling impurities containing acrylic acid dimer, acrylic acid and malefic acid were introduced into an acrylic acid recovery column composed of a distillation column equipped with a thin-film evaporating device. In the distillation column, conducted was distillation under a condition of 10 to 100 mmHg with a bottom temperature of the column being 60 to 120° C. Acrylic acid was distilled off from a top of the column and then recovered. Bottoms were introduced from the thin film vaporizer into a pyrolyzing tank, whereat acrylic acid dimer in the bottoms was decomposed at temperatures of 120 to 220° C., and thereafter, at least a part of bottoms of the pyrolyzing tank was recirculated into the thin film vaporizer and/or the distillation column, at a ratio of 1 to 20 times in volume with respect to the high boiling impurities containing acrylic acid dimer, acrylic acid and malefic acid.

Condensed bottoms obtained from the above process were fed to the storage tank 1 as shown in FIG. 1 through waste oil supply pipe 2.

A flat plate was used as a bottom plate of the storage tank 1. A propeller type agitator 4 was used as an agitator for mixing waste oil in the storage tank 1, and the agitator 4 was operated continuously at constant speed. The storage tank 1 was equipped with a diaphragm type liquid level meter 6 for measuring a waste oil level in the storage tank 1. A part of the waste oil extracted through the waste oil draw-off pipe 3 was circulated to the storage tank 1 through waste oil return pipe 7. A vertical multi-pipe heat exchanger 5 was mounted on the storage tank for condensing vaporized waste oil. A gas was passed through a tube-side of the heat exchanger, and the cooling water was passed through a shell-side of the heat exchanger.

Storage tank capacity: 5 $m^3$

Gradient α: 1/30 (2° downwardly inclined to the waste oil draw-off pipe 3)

Heat transfer area of the vertical multi-pipe heat exchanger: 2 $m^2$

Temperature at an entrance of the shell-side: 32° C.

Flow rate at the shell-side: 2 $m^3$/h

Composition of the waste oil: acrylic acid (5 mass %), acrylic acid dimer (30 mass %), malefic acid (5 mass %), impurities (60 mass %)

Viscosity of the waste oil: 0.04 Pa·s (40 ep) at 100° C.

Temperature of the waste oil in the storage tank: 120° C.,

Feed rate of the waste oil: 2000 kg/h

Circulating rate of the waste oil through the waste oil return pipe 7: 2500 kg/h Draw off rate of the waste oil from the storage tank 1 through the-waste oil draw-off pipe 3: 200 kg/h After a one month operation, no polymerized products nor precipitates were generated at a bottom of the storage tank 1, and no clogging of the pipes 3 and 7 occurred.

COMPARATIVE EXAMPLE 1

The same operation was conducted as that of Example 1, except that the gradient α was set at zero (no slope was provided).

After a one month operation, polymerized products were accumulated at the bottom of the storage tank 1 and the pipes 3 and 7 were clogged by the polymerized products.

EXAMPLE 2

The same operation was conducted as that of Example 1, except that the draw off rate of the waste oil from the storage tank 1 through the waste oil draw-off pipe 3 was set at 300 kg/h.

After a one month operation, no polymerized products nor precipitates were generated at the bottom of the storage tank 1, and no clogging of the pipes 3 and 7 occurred.

COMPARATIVE EXAMPLE 2

The same operation was conducted as that of Example 2, except that the gradient α was set at zero (no slope was provided).

After a one month operation, polymerized products were accumulated at the bottom of the storage tank 1, and the pipes 3 and-7 were clogged by the polymerized products.

EXAMPLE 3

Waste oil obtained from the same process as that of Example 1 was fed to a storage tank 1 having a circular cone type bottom plate shown in FIG. 3. A propeller type agitator was used as an agitator 4 for mixing the waste oil in the storage tank 1, and the agitator 4 was operated continuously. A diaphragm type liquid level meter was equipped for measuring the waste oil level in the storage tank. A part of the waste oil extracted through oil return pipe 7 was circulated to the storage tank through pipe 7. A vertical multi-pipe heat exchanger was mounted on the storage tank for condensing vaporized waste oil. Gas was passed through a tube-side of the heat exchanger, and cooling water was passed through a shell-side of the heat exchanger.

Storage tank capacity=10 $m^3$

Gradient α: 1/4 (15° downwardly inclined to the waste oil draw-off pipe) Composition of the waste oil: butyl acrylate (5 mass %), acrylic acid (5 mass %), impurities (90 mass %)

Viscosity of the waste oil: 0.005 Pa·s (5 cp) at 100° C.,

Temperature of the waste oil in the storage tank: 160° C.

Feed rate of the waste oil: 2000 kg/h

Circulating rate of the waste oil through pipe 7:1 500 kg/h

Draw off rate of the waste oil from the storage tank 1 through the waste oil draw-off pipe 3: 300 kg/h After a one month operation, no polymerized products and precipitates were generated in the storage tank, and no clogging of the pipes 3 and 7 occurred.

COMPARATIVE EXAMPLE 3

The same operation was conducted as that of Example 3, except that the gradient α was set at zero (no slope was provided).

After a one month operation, polymerized products were accumulated at the bottom of the storage tank, and the pipes 3 and 7 were clogged by the polymerized products.

EXAMPLE 4

The same operation was conducted as that of Example 1, except that the draw off rate of the waste oil from the storage tank 1 through the waste oil draw-off pipe 3 was set at 500 kg/h.

After a one month operation, no polymerized products nor precipitates were generated at the bottom of the storage tank 1, and no clogging of the pipes 3 and 7 occurred.

COMPARATIVE EXAMPLE 4

The same operation was conducted as that of example 4, except that the gradient α was set at zero (no slope was provided).

After a one month operation, polymerized products were accumulated at the bottom of the storage tank, and the pipes 3 and 7 were clogged by the polymerized products.

This application is based on Japanese patent application No. 2000-043411 filed on Feb. 21, 2000, whose priority is claimed under the Paris Convention; thus the contents thereof are incorporated by reference.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalents of such metes and bounds are therefore intended to be embraced by the claims.

What is claimed is:

1. A storage tank for storing viscous oil that contains easily polymerizable compounds, comprising:

a bottom plate;

a side wall;

an inlet pipe;

an oxygen-containing gas supply pipe; and a draw-off pipe, with said bottom plate sloping downwardly toward said draw-off pipe at a gradient of at least 1/200.

2. The storage tank according to claim 1, wherein a source of oxygen is in fluid communication with said oxygen-containing gas supply pipe.

3. The storage tank according to claim 2, wherein said draw-off pipe is positioned at a lowermost part of said bottom plate.

4. The storage tank according to claim 2, wherein the viscous oil is bottoms obtained by distilling a liquid containing (meth)acrylic acid and ester thereof.

5. The storage tank according to claim 2, wherein said storage tank is equipped with at least one of an agitator, a diaphragm liquid level meter and a temperature controlling device.

6. The storage tank according to claim 2, wherein said storage tank is equipped with a condenser.

7. The storage tank according to claim 6, wherein said oxygen-containing gas supply pipe is in fluid communication with said condenser.

8. The storage tank according to claim 6, wherein said oxygen-containing gas supply pipe includes a first discharge opening for supplying oxygen-containing gas into an interior of said storage tank, and a second discharge opening for supplying oxygen-containing gas into said condenser.

9. The storage tank according to claim 1, further comprising a waste oil return pipe.

10. The storage tank according to claim 9, wherein said draw-off pipe is positioned at a lowermost part of said bottom plate.

11. The storage tank according to claim 9, wherein the viscous oil is bottoms obtained by distilling a liquid containing (meth)acrylic acid and ester thereof.

12. The storage tank according to claim 9, wherein said storage tank is equipped with at least one of an agitator, a diaphragm liquid level meter and a temperature controlling device.

13. The storage tank according to claim 9, wherein said storage tank is equipped with a condenser.

14. The storage tank according to claim 13, wherein said oxygen-containing gas supply pipe is in fluid communication with said condenser.

15. The storage tank according to claim 13, wherein said oxygen-containing gas supply pipe includes a first discharge opening for supplying oxygen-containing gas into an interior of said storage tank, and a second discharge opening for supplying oxygen-containing gas into said condenser.

16. The storage tank according to claim 1, wherein said draw-off pipe is positioned at a lowermost part of said bottom plate.

17. The storage tank according to claim 1, wherein the viscous oil is bottoms obtained by distilling a liquid containing (meth)acrylic acid and ester thereof.

18. The storage tank according to claim 1, wherein said storage tank is equipped with at least one of an agitator, a diaphragm liquid level meter and a temperature controlling device.

19. The storage tank according to claim 1, wherein said storage tank is equipped with a condenser.

20. The storage tank according to claim 19, wherein said oxygen-containing gas supply pipe is in fluid communication with said condenser.

21. The storage tank according to claim 19, wherein said oxygen-containing gas supply pipe includes a first discharge opening for supplying oxygen-containing gas into an interior of said storage tank, and a second discharge opening for supplying oxygen-containing gas into said condenser.

* * * * *